US006390073B1

(12) United States Patent
Meiller et al.

(10) Patent No.: US 6,390,073 B1
(45) Date of Patent: May 21, 2002

(54) EVAPORATIVE EMISSION STORAGE CANISTER WITH INTEGRAL FILTER AND VENT SOLENOID

(75) Inventors: Thomas Charles Meiller, Pittsford; Martin A. Martina, Penfield, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/383,841

(22) Filed: Aug. 26, 1999

(51) Int. Cl.[7] ..... F02M 37/04
(52) U.S. Cl. ..... 123/519; 123/510
(58) Field of Search ..... 123/518, 519, 123/520, 521, 510, 516

(56) References Cited

U.S. PATENT DOCUMENTS 5,450,833 A * 9/1995 Denz et al. ..... 123/520
5,501,198 A * 3/1996 Koyama ..... 123/520
5,560,347 A * 10/1996 Reddy et al. ..... 123/520
5,623,911 A * 4/1997 Kiyomiya et al. ..... 123/520
5,857,446 A * 1/1999 Norton ..... 123/520
5,878,729 A 3/1999 Covert et al.
6,050,245 A * 4/2000 Cook et al. ..... 123/520
6,053,151 A * 4/2000 Cook et al. ..... 123/520
6,161,526 A * 12/2000 Sakata et al. ..... 123/519

* cited by examiner

*Primary Examiner*—Carl S. Miller
(74) *Attorney, Agent, or Firm*—Vincent A. Chichosz

(57) ABSTRACT

Onboard refueling vapor recovery canister for a gasoline-powered vehicle including an unequally-divided carbon bed, a vent solenoid, and a high-capacity, self-cleaning vent filter. Integral configuration of the canister reduces its size and also increases the allowable carbon volume over prior art canisters, permitting use of a lower grade carbon at a significant cost savings while meeting all working capacity requirements. The filter box has an air inlet port and contains a high-efficiency filter wrapped around a feature enclosing a solenoid for opening and closing the air flow through the canister. Wrapping the filter increases the available surface area by more than 50% over that of a flat filter. Outward air flow during refueling partially backflushes the filter, thereby extending the useful life of the filter media. The carbon absorber is divided into two sequential beds of unequal length but equal cross-sectional area, which improves the diurnal efficiency performance of the canister relative to known canisters.

20 Claims, 7 Drawing Sheets

EVAPORATIVE EMISSION STORAGE CANISTER WITH INTEGRAL FILTER AND VENT SOLENOID

TECHNICAL FIELD

The present invention relates to automotive emission storage canisters, more particularly, to an emission storage canister having a vent solenoid, and most particularly, to an emission storage canister having integral carbon absorber, vent solenoid, and high-efficiency air inlet vent filter.

BACKGROUND OF THE INVENTION

Emission storage canisters are provided on automotive vehicles to prevent the discharge of fuel vapors outside vehicles during refueling, known as onboard refueling vapor recovery (ORVR), and also during extended periods of vehicle inactivity.

Typically, a canister containing activated carbon is mounted within a vehicle in communication, via a first or vapor inlet port, with the headspace in the fuel tank; via a second or vapor outlet port, with a vacuum source in the engine intake manifold; and via a third or vent port, with the atmosphere outside the vehicle. During refueling, the fill pipe is sealed against vapor leakage, either by a flexible gasket surrounding the fill nozzle or by a liquid seal in the fill pipe. As the tank is filled, air and vapors in the headspace above the fuel are forced through the vapor inlet port into the canister. The vapors are adsorbed onto the charcoal bed, and the air is discharged through the vent port. During subsequent operation of the vehicle, the engine vacuum draws air through the vent port, gradually purging the adsorbed vapors via the vapor outlet port into the engine's combustion flow and preparing the canister for the next refueling. Air also flows back through the vent port into the fuel tank as needed to replace fuel being consumed by the engine.

The air vent port is normally open during periods of non-operation of the vehicle. Fuel tank vapors must be adsorbed by the canister before reaching the vent port. This function is known in the art as diurnal adsorption. Such diurnally adsorbed fuel is also desorbed and conveyed by vacuum to the engine upon startup.

Federal regulations require that each vehicle be equipped to conduct an onboard diagnostic (OBD) leak test of the evaporative emissions system. Several manufacturers use a vacuum decay OBD which requires apparatus for closing off the vapor outlet and vent ports, the vapor inlet port being effectively sealed during test by the fuel tank cap.

Typically, an ORVR canister is mounted immediately adjacent the fuel tank to minimize vapor flow restriction into the canister. Since the fuel tank commonly is located near the rear of the vehicle and the engine at the front, a relatively long hose run is required to connect the canister to the engine intake. A first electric solenoid valve at the canister can close the canister vent port, and a second solenoid valve at the engine can close the vapor outlet line. To test the system for leaks, first the vent port is closed, exposing the system to full engine vacuum, then the outlet line is closed. The OBD system monitors the rate of decay of the captured vacuum.

Mounting the canister at the rear of the vehicle exposes the vent port to dust and debris which, if allowed to enter the canister, can foul the vent solenoid and internal passages, gradually clogging the solenoid valve and the canister and causing failure of the seal test. Entry of dust and debris can also cause operational problems with refueling of the vehicle, including failure to fill properly and premature shutoffs of the refueling nozzle. To prevent such entry, a prior art approach, disclosed in U.S. Pat. No. 5,878,729 issued Mar. 9, 1999 to Covert et al. ('729) and incorporated herein by reference, provides two separate vent ports, an outlet vent port with a check valve for releasing fuel tank air during refueling, and an inlet vent port connected to the downstream side of the engine air filter. An additional check valve is disposed between the inlet vent port and the engine to prevent vapors flowing into the air cleaner during refueling and causing an over rich fuel/air mixture being fed to the engine at start up. This reference also discloses the concept of incorporating a filter directly into the canister housing ahead of the vent solenoid but rejects the idea as being "of no real use for filtering the air vented to the outside during fuel adsorption, when it would merely serve as an air flow impediment."

A prior art canister, Model No. AK3612 manufactured by Knecht Filterwerke, GmbH, Stuttgart, Germany, incorporates a filter and vent solenoid in a refueling emission storage canister. This canister has several important shortcomings: a) the solenoid projects outwards from the canister, increasing significantly the space required for the canister; b) the flow path through the canister and solenoid requires a large, high-constant solenoid spring to open the vent valve because the vacuum force from the OBD system urges the valve toward the valve-closed position; c) a relief valve in the canister case prevents the engine vacuum from collapsing the fuel tank in the event the solenoid fails to open when OBD testing is completed; d) the filter media is flat, which minimizes the area available and thus the useful life of the media; and e) the filter media is permanently mounted and thus is not accessible for periodic cleaning or replacement as needed.

What is needed is an evaporative emission storage canister which integrates an inlet vent filter with a carbon adsorption bed and a vent solenoid in such a way that a) the filter does not serve as an impediment to reverse air flow through the filter, preferably over the expected lifetime of the vehicle in which the canister is mounted; b) the filter media is configured to maximize the filtration area consistent with the available volume of the filter box; c) the filter media is readily accessible for cleaning or replacement; d) the solenoid valve is disposed in a port within the body of the canister; and e) opening of the vent valve is assisted by OBD vacuum within the canister, and therefore a relief valve to protect the fuel tank is not required.

SUMMARY OF THE INVENTION

The present invention is directed to an improved onboard refueling vapor recovery canister for a vehicle including an unequally-divided carbon bed, a vent solenoid, and a high-capacity, self-cleaning vent filter. The integral configuration of the canister provides a significant reduction in the volume of space required to provide the recovery function and an increase in carbon volume over prior art canisters, permitting use of a lower grade carbon at a significant cost savings while meeting all working capacity requirements.

The canister is provided at an air inlet port with an internal filter box for a high-efficiency filter media, the filter box having a feature for receiving therein a canister vent solenoid for opening and closing on demand the air inlet port. The vent solenoid is retained in the filter box as by a twist lock or retaining clip.

Passages within the feature and the canister permit flow of air and/or fuel vapors through the filter, the solenoid valve, and the carbon bed. Preferably, the filter box is closed by a removable cover such that the filter may be removed for cleaning or replacement as needed.

In a preferred embodiment, the feature is semi-cylindrical with discontinuous radial ridges and the filter media is wrapped thereupon in a horseshoe-shaped configuration such that the filtration area is increased by more than 50% over that obtainable using a flat filter media within the same size filter box. The relatively large filtration area prevents outward air flow restriction during refueling. It was expected that such restriction might become significant with long use of the filter, but it has been found unexpectedly that the outward air flow serves to partially backflush the filter each time the vehicle is refueled, thereby extending the useful life of the filter media.

In a further preferred embodiment, the canister may be oriented such that particles flushed from the media surface which are not carried out of the canister can fall under gravity to the lower side of the filter box where they can accumulate harmlessly over a long period of canister use.

In a further preferred embodiment, the carbon absorber bed is divided into two sequential sub-beds of unequal length but equal cross-sectional area, the longer sub-bed being adjacent to the vapor inlet port. This configuration improves the diurnal efficiency (vehicle inoperative) performance of the canister relative to known canisters having equal length beds without increasing flow restriction of the carbon beds.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
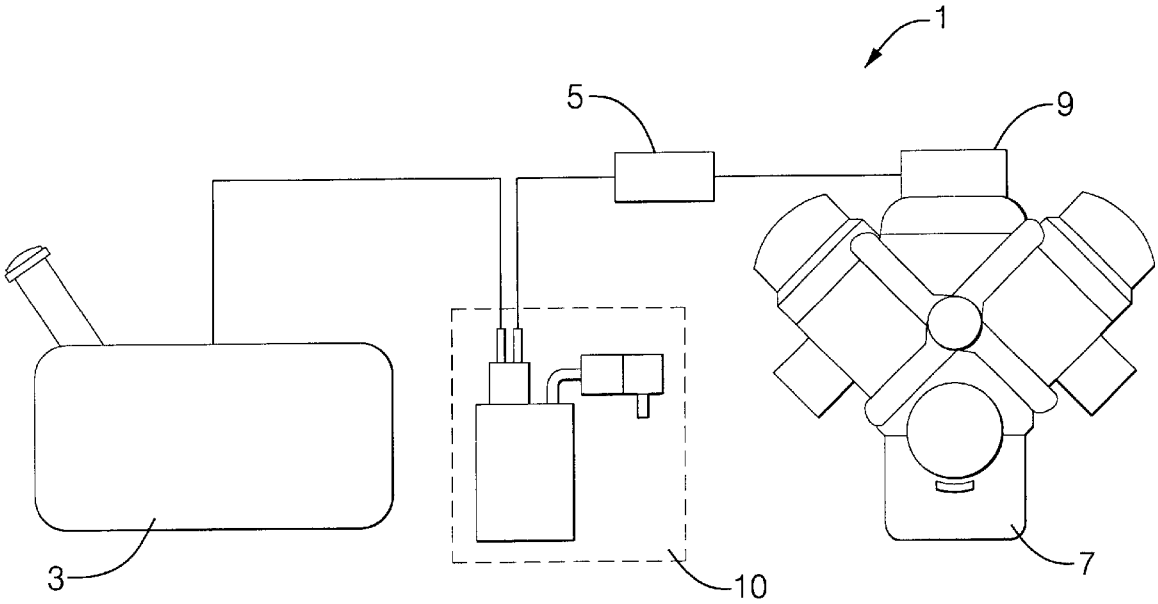
FIG. 1 is a schematic drawing of an onboard refueling vapor recovery system.

Referring to FIG. 1, an onboard refueling vapor recovery system 1 in accordance with the invention includes a fuel tank 3, vapor outlet shut-off solenoid 5, engine 7, engine fuel intake 9, and integrated evaporative emission storage canister 10. Canister 10 includes a vapor inlet port 32, vapor outlet port 34, carbon adsorption bed 22, vent port 27, filter 38, and vent port shut-off solenoid 46.

Referring to FIGS. 2–6, evaporative emission storage canister 10 in accordance with the invention and having a flow path therethrough includes a canister housing 12 which may be formed of metal or plastic in known fashion and preferably is formed by injection molding of a suitable polymeric resin, for example, a polyamide such as nylon. Housing 12 includes exterior walls 14, a bottom 16, and a top 18 forming first and second chambers 20,21 for holding an activated carbon adsorption bed 22, disposed as sub-beds 22,22', respectively, for adsorbing and desorbing fuel tank evaporative emissions, and a filter box 24 for filtering ambient particles from outside air entering housing 12. Chambers 20,21 are partially separated by an internal partition 26, flow communication therebetween being through gap 28 between separator 26 and bottom 16. Preferably, housing 12 is further provided with at least one mounting feature 30, e.g., a bracket, dovetail, or the like, for mounting canister 10 to a vehicle (not shown).

Top 18 is provided with a vapor inlet port 32 for connection to the vehicle's fuel tank 3 and a vapor outlet port 34 for connection to the vehicle's engine intake 9. Ports 32 and 34 are formed to be in continuous flow communication with each other and with chambers 20,21 within canister 10.

Figure 6:
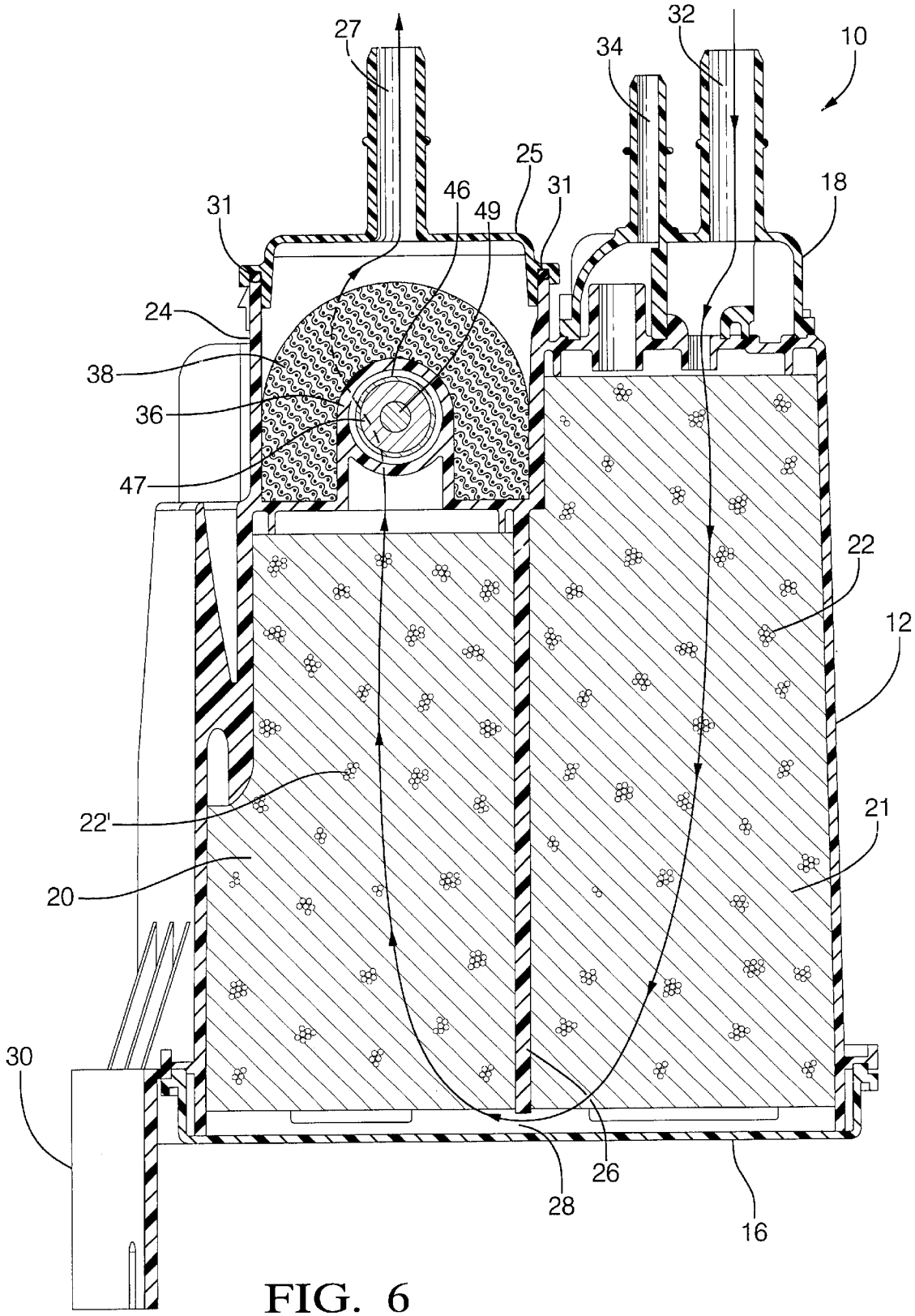
FIG. 6 is an elevational view of the canister shown in FIG. 2 partially in cross-section taken along line 6—6 in FIG. 3, showing flow through the canister during vehicle refueling or diurnal loading.
Figure 7:
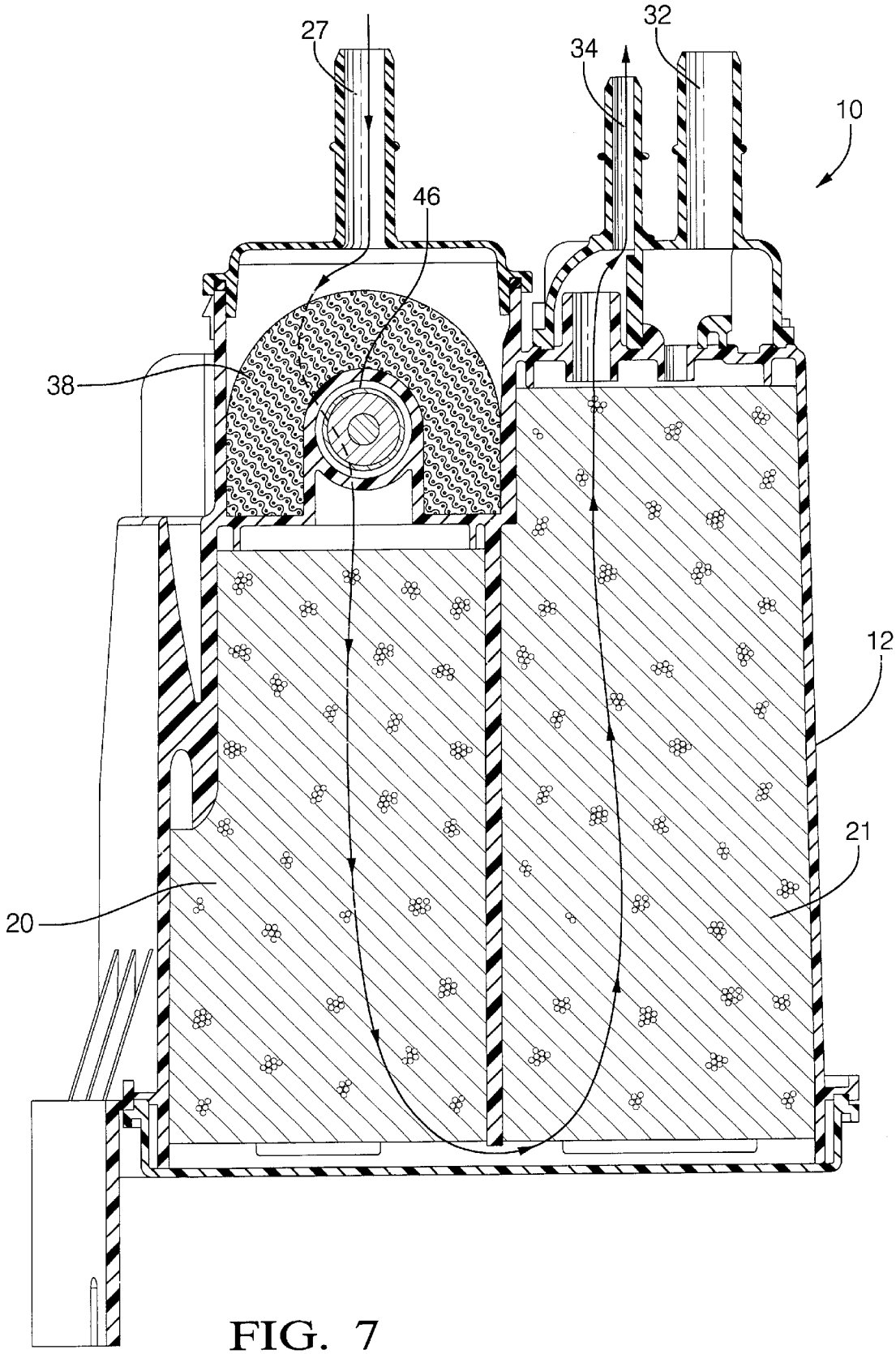
FIG. 7 is a view like that shown in FIG. 6, showing flow through the canister during purging of stored emissions.
Figure 8:
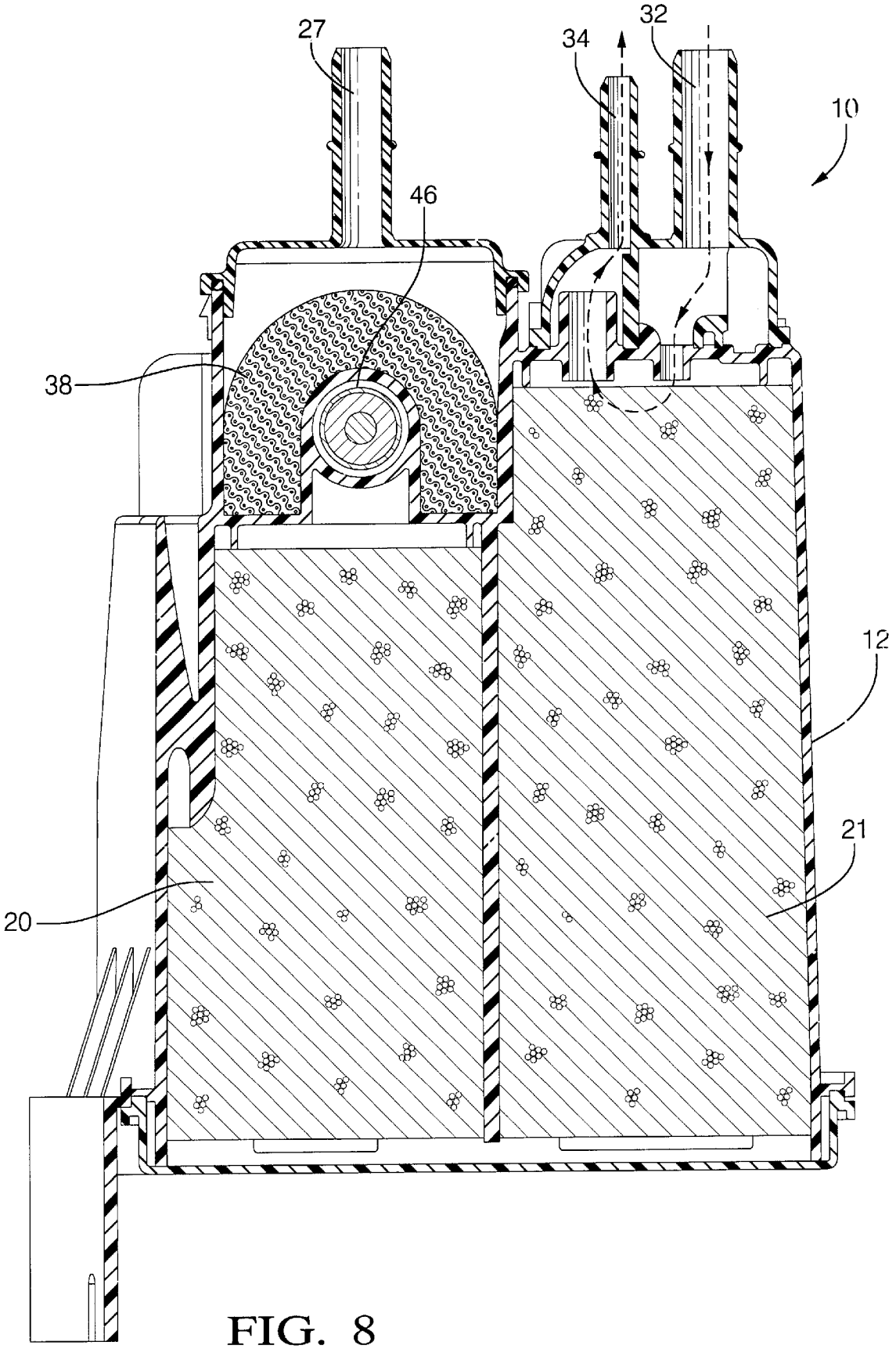
FIG. 8 is a view like that shown in FIG. 6, showing flow status of the canister during OBD testing.

Filter box 24 is provided with an internal feature 36 for supporting a filter media element 38 for filtering outside air entering chamber 20, and with a top 25 having a vent port 27 in communication with the atmosphere outside of canister 10. Feature 36 is preferably semi-cylindrical in its outer surface, preferably having a plurality of discontinuous protuberances, preferably such as ribs 37, for maintaining an air flow passageway for escape of filtered air between filter 38 and feature 36. Filter 38 is non-planar and preferably horseshoe-shaped as shown in FIGS. 6–8 to conform to feature 36 and to provide a greater filtering surface than would be obtainable with a flat filter element in the same size filter box.

Feature 36 contains a passageway 39, preferably cylindrical, which is open at first and second ends thereof. First end 40 cooperates with an opening 43 in the side of passageway 39 to define a flow path between filter box 24 and chamber 20. Second end defines a port 42 in wall 44 of filter box 24 for receiving a solenoid-operated valve assembly 46 within feature 36 for regulating the flow of air along the flow path through canister 10.

Figure 3:
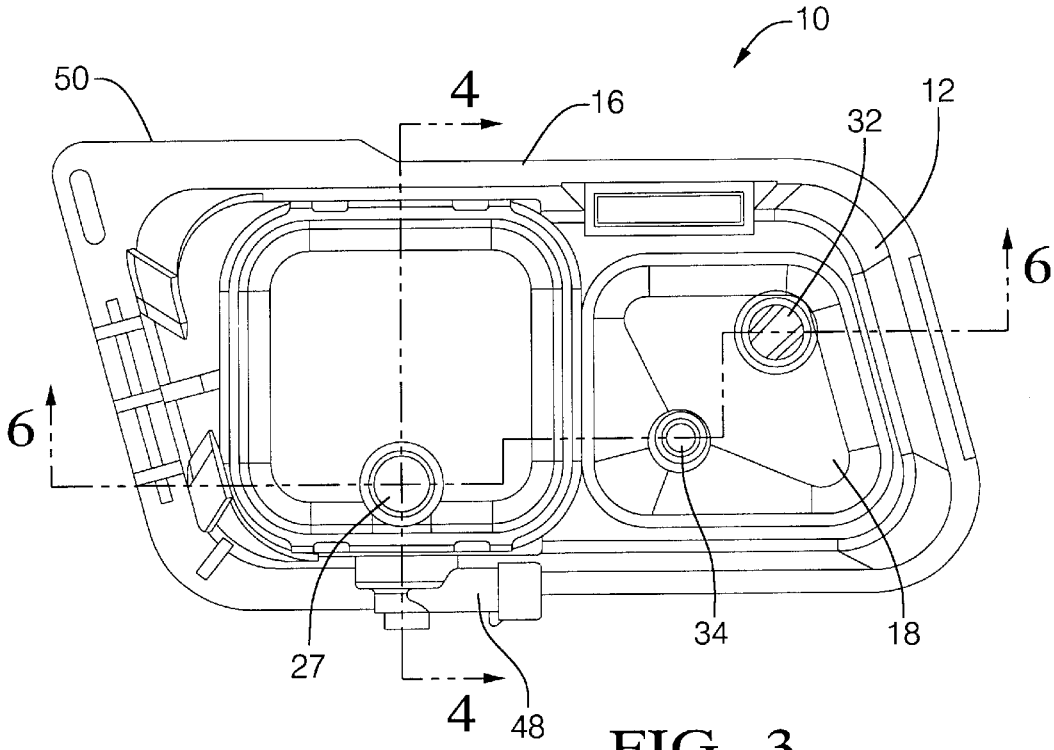
FIG. 3 is a plan view of the canister shown in FIG. 2.
Figure 2:
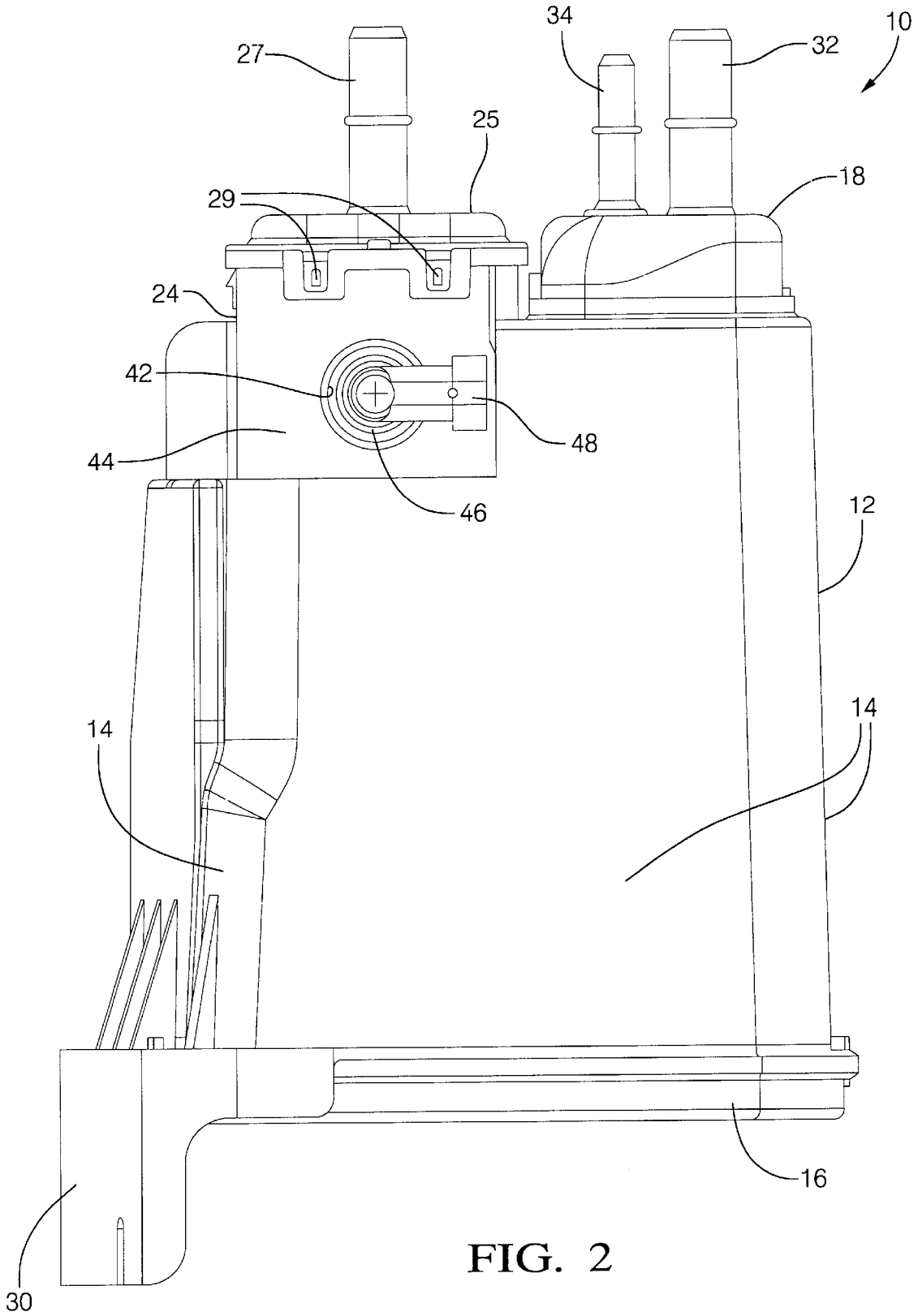
FIG. 2 is an elevational view of an evaporative emission storage canister in accordance with the invention.
Figure 4:
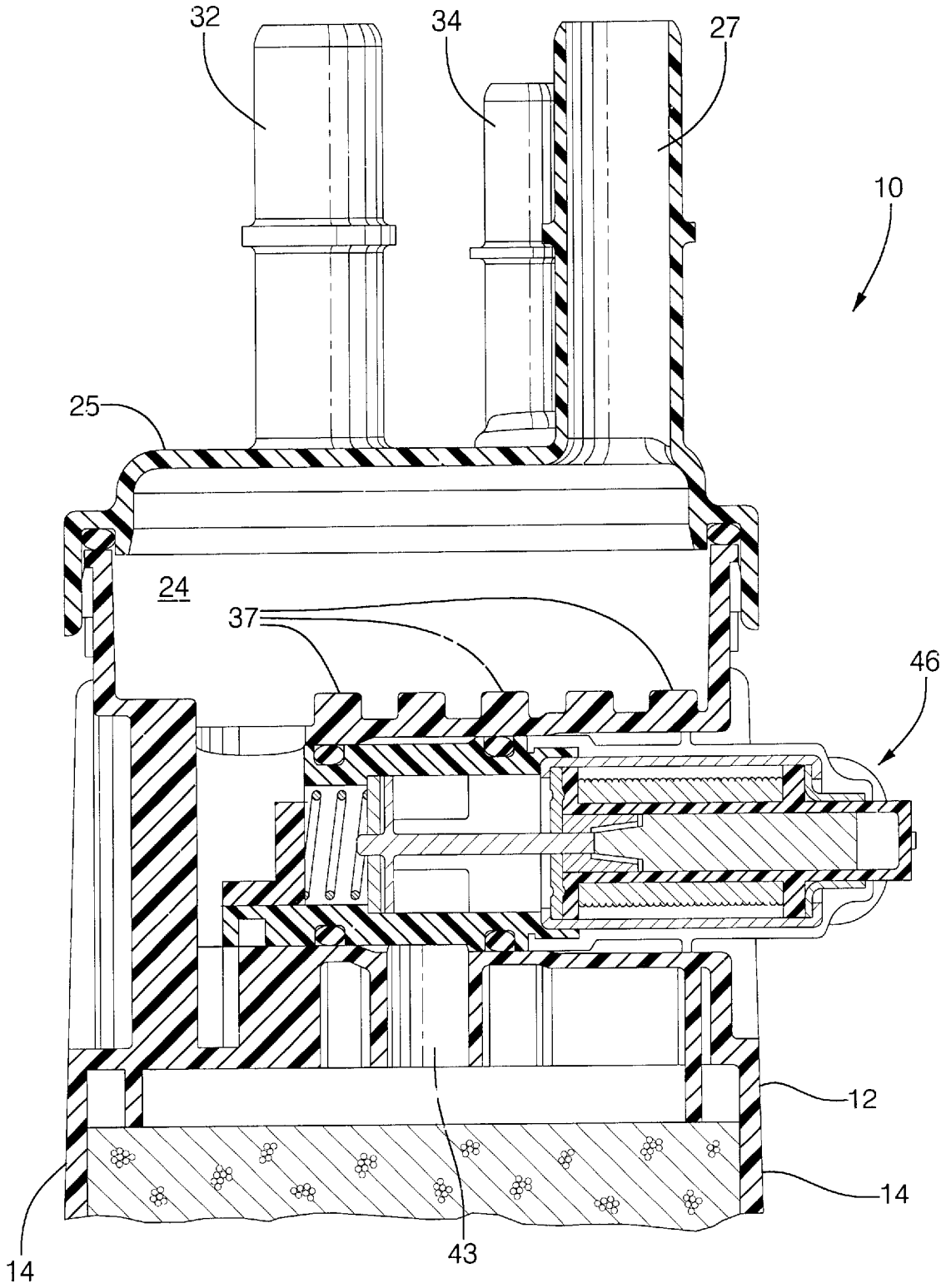
FIG. 4 is an elevational view of the upper portion of the canister shown in FIG. 2 partially in cross-section taken along line 4—4 in FIG. 3.
Figure 5:
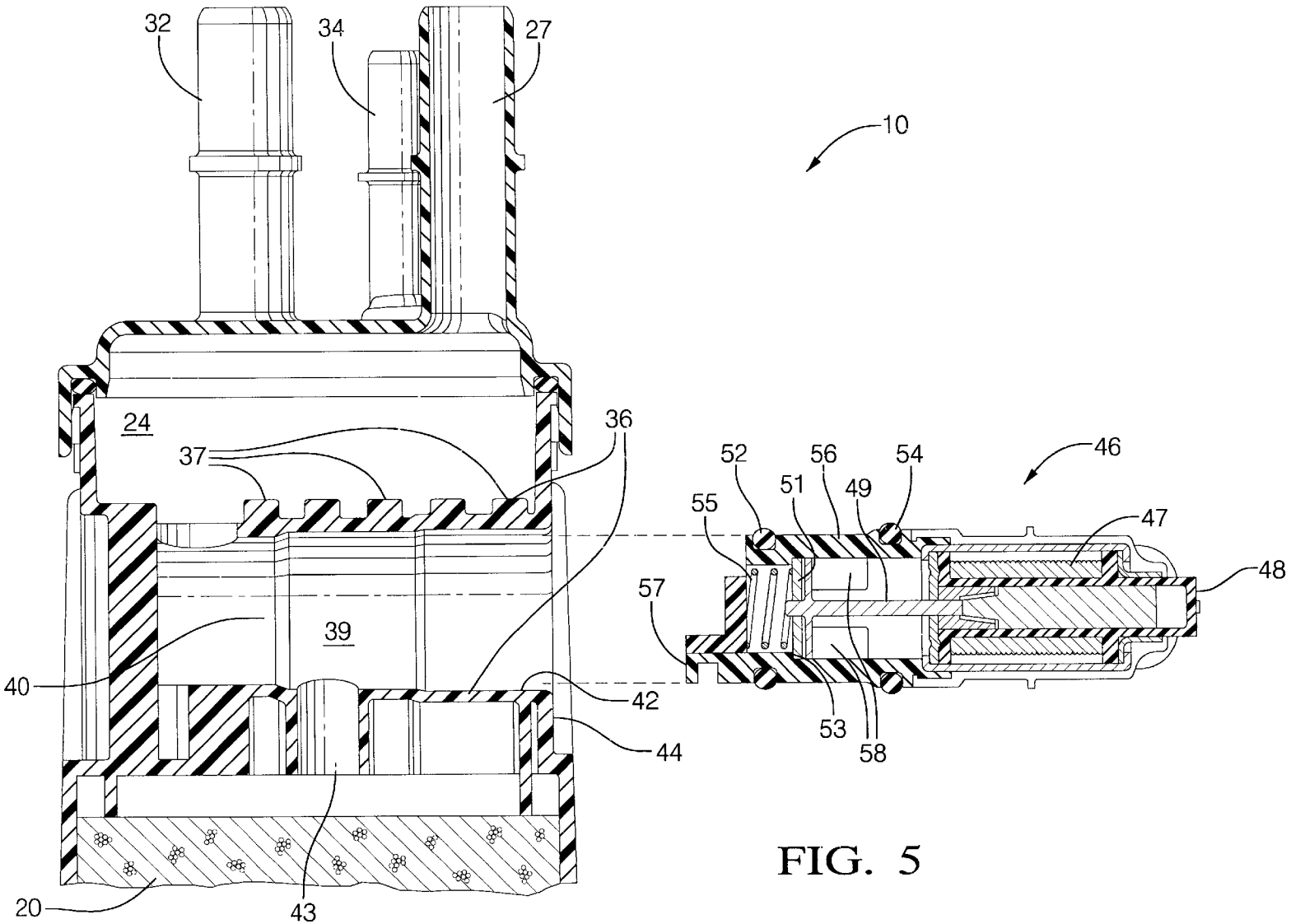
FIG. 5 is an exploded view of the canister shown in FIG. 4, showing replaceable removal of the canister vent solenoid from the canister.

Solenoid assembly 46 comprises a plurality of windings 47; a cylindrical barrel 56 extending axially from the windings; an axially-slidable armature 49 concentric with and extendable from the windings; valve head 51 attached to armature 49; valve seat 53 attached to barrel 56 for matably cooperating with the valve head responsive to energizing and de-energizing of the solenoid to close and open, respectively, the flow path through the valve; and opening spring 55. Advantageously, valve assembly 46 is contained within feature 36 such that only electrical connector 48 protrudes significantly beyond port 42. Preferably, connector 48 is configured for connection such that the connector is contained within the footprint 50 of bottom 16, as shown in FIG. 3. Solenoid valve assembly 46 may be retained within feature 36 by conventional means, for example, by twist lock 57, snap retaining tab, or the like.

Solenoid valve 46 is substantially full-fitting within passageway 39 and is provided with first and second O-rings 52,54 spaced apart along barrel 56 for sealing against flow leakage along passageway 39 during use. Barrel 56 is provided with perforate openings 58 which correspond with opening 43 such that when assembly 46 is de-energized, flow is enabled through port 40, through barrel 56, and through openings 58 and 43, thus establishing filtered flow in either direction between chamber 20 and the outside. When assembly 46 is energized, port 40 is closed and chamber 20 is isolated from the outside.

Preferably, filter box top 25 is sealably and removably attached to box 24, as by snap latches 29 and O-ring 31, for easy cleaning or replacement of filter element 38.

Operation of canister 10 is shown in FIGS. 6–8. In FIG. 6, during vehicle refueling (engine not running), solenoid assembly 46 is de-energized, opening vent port 27 to the outside. Vapors and air being expelled from the fuel tank enter the canister via vapor inlet port 32 and flow through chambers 21,20. Fuel vapors are adsorbed onto carbon beds 22,22', respectively, and entrained air is exhausted through vent port 27. Because the flow restriction of the beds, filter, and vent port is low, insignificant amounts of air and vapor are passed forward to the engine during refueling, eliminating the need for a check valve as required in the '729 patent cited supra. An unexpected advantage of a canister in accordance with the invention is that air directed outwards through the filter media during refueling is sufficiently turbulent to partially backflush the media of particulates collected during operation of the vehicle since the previous refueling, thus extending significantly the useful life of the filter between cleaning or replacement.

As shown in FIG. 7, when the vehicle is in normal operation after refueling, solenoid assembly 46 remains de-energized. Engine vacuum applied through vapor outlet port 34 draws air into the canister through vent port 27 and thence into the engine, thereby gradually de-adsorbing and purging fuel vapors from the canister into the engine, thus preparing the canister for the next refueling and/or diurnal loading.

At a predetermined time after engine start-up, the vehicle OBD system performs an emissions storage system leak test as described supra. Solenoid valve 46 closes flow port 40, as shown in FIG. 8, allowing the canister to be subjected to the full engine vacuum. Subsequently, solenoid valve 5 between vapor outlet port 34 and the engine intake 9 is closed and the decay rate of the vacuum thus captured is determined. As indicated in FIG. 8, there is no flow through the canister during a leak test.

An advantage of the configuration and location of the solenoid assembly in accordance with the invention is that the valve is closed against the engine vacuum by the force of the energized solenoid. When the solenoid is de-energized, opening of the valve by spring 55 is assisted by the engine vacuum rather than opposed by it, as described for the Knecht canister supra. Thus, a canister in accordance with the present invention does not require a separate check valve in the housing to prevent collapse of the fuel tank if the solenoid fails. The solenoid is effectively its own check valve.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An evaporative emission storage canister having a flow path therethrough, comprising:

a) a housing;

b) means within said housing in said flow path for adsorbing and desorbing evaporative fuel emissions;

c) a solenoid valve within said housing including an armature having a valve head slidable in a perforate barrel and a valve seat supported by said perforate barrel, for regulating the flow of air along said flow path, said valve being disposed in said flow path such that engine vacuum applied to said adsorbing and desorbing means assists in opening said valve; and d) a filter element for filtering air entering said valve.

2. A canister in accordance with claim 1 wherein said housing further comprises a vapor inlet port and a vapor outlet port in said flow path, both ports being in flow communication with said means for adsorbing and desorbing.

3. A canister in accordance with claim 1 further comprising a filter box for holding said filter element.

4. A canister in accordance with claim 3 wherein said filter box further comprises a vent port in said flow path.

5. A canister in accordance with claim 3 wherein said filter box further comprises an attachably removable top.

6. A canister in accordance with claim 3 further comprising a feature formed in said filter box for supporting said filter element therein.

7. A canister in accordance with claim 6 wherein said feature includes a plurality of surface protuberances for supporting said filter element and maintaining an air flow passageway between said filter element and said feature.

8. A canister in accordance with claim 6 wherein said feature is semi-cylindrical.

9. A canister in accordance with claim 6 wherein said filter element is non-planar.

10. A canister in accordance with claim 6 wherein said feature has a central passageway in communication with said airway and said adsorbing and desorbing means for receiving said solenoid valve.

11. A canister in accordance with claim 1 wherein said solenoid valve further includes a twist lock for retaining said valve in said canister.

12. A canister in accordance with claim 1 wherein said absorbing and desorbing means further comprise a carbon bed.

13. A canister in accordance with claim 12 wherein said carbon bed further comprises first and second sub-beds of unequal flow length.

14. An evaporative emissions storage canister having an integral configuration and a flow path therethrough, comprising:

a) a housing;

b) means located within said housing in said flow path for adsorbing and desorbing evaporative fuel emissions;

c) a solenoid valve integrally located within said housing for regulating the flow of air along said flow path;

d) a filter box integrally located within said housing for filtering air entering said solenoid valve, wherein said filter element is non-planar.

15. A canister in accordance with claim 14 wherein said non-planar filter element is semi-cylindrically shaped.

16. A canister in accordance with claim 14 further comprising a filter box for holding said filter element, wherein said filter box includes a feature for supporting said filter element therein, and wherein said feature is semi-cylindrical and includes a plurality of surface protuberances for supporting said filter element and maintaining an air flow passageway between said filter element and said feature.

17. A canister in accordance with claim 14 wherein said absorbing and desorbing means comprise a carbon bed, and said carbon bed includes first and second subbeds of unequal flow length.

18. An evaporative emissions storage canister having an integral configuration and a flow path therethrough, comprising:

a) a housing;

b) means located within said housing in said flow path for adsorbing and desorbing evaporative fuel emissions;

c) a solenoid valve integrally located within said housing for regulating the flow of air along said flow path;

d) a filter box integrally located within said housing;

e) a filter element integrally located within said filter box for filtering air entering said solenoid valve, wherein said filter box includes a feature comprising an outer surface having a plurality of protuberances located thereon for supporting said filter element and maintaining an air flow passageway between said filter element and said feature, the outer surface of said feature being semi-cylindrically shaped.

19. A canister in accordance with claim 18 wherein said filter element is non-planar.

20. A canister in accordance with claim 19 wherein said filter element has a filtration surface area that is increased by more than about 50% over the filter surface area that would be obtainable using a flat planar filter element within a same size filter box.

* * * * *